United States Patent [19]

Armetti

[11] 3,946,929

[45] Mar. 30, 1976

[54] CONTAINER MAKING MACHINE

[76] Inventor: Massimo Armetti, Viale Volturno 33, Cervia (Ravenna), Italy

[22] Filed: May 1, 1974

[21] Appl. No.: 466,034

[30] Foreign Application Priority Data

May 4, 1973 Italy ..... 23719/73

[52] U.S. Cl. ..... 228/15.1; 29/463; 53/183; 228/173

[51] Int. Cl.[2]B65B 43/08; B21D 39/03; B65B 47/00

[58] Field of Search ..... 53/183, 184; 29/463; 228/15.1, 17, 173

[56] References Cited

UNITED STATES PATENTS

| | | | |
|---|---|---|---|
| 2,697,316 | 12/1954 | Alvord | 53/184 X |
| 3,092,940 | 6/1963 | David | 53/183 X |
| 3,199,551 | 8/1965 | Hall et al. | 53/183 X |
| 3,729,885 | 5/1973 | Mosetich et al. | 53/184 X |

*Primary Examiner*—Travis S. McGehee
*Assistant Examiner*—Horace M. Culver
*Attorney, Agent, or Firm*—Michael J. Striker

[57] ABSTRACT

A container making machine for forming a plurality of identical equidistantly spaced recesses in aluminum strips which are subsequently welded to each other to form compartments for reception of suppositories or the like, in which the strips prior to the forming of the recesses therein are first provided with closely spaced small corrugations extending transversely to the strips to permit the subsequent forming of relatively deep recesses therein without tearing of the strip material. The machine includes corrugation forming rollers, recess forming means downstream of the rollers, heat welding means downstream of the recess forming means, and means for transporting the strips stepwise through the nip of the corrugation forming rollers, the recess forming means and the heat wleding means.

7 Claims, 2 Drawing Figures

CONTAINER MAKING MACHINE

Figure 1:
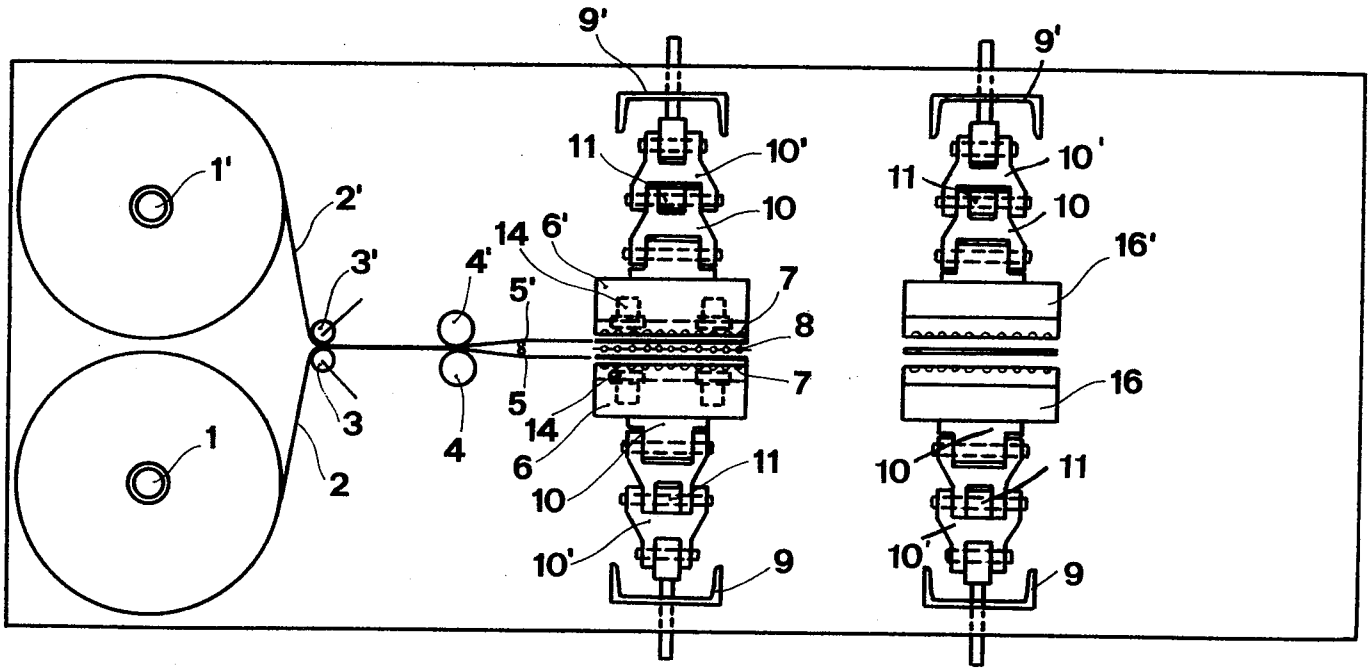

This invention relates to an improved container making machine, adapted to effect the formation of a plurality of side-to-side arranged recesses between two overlapped aluminium strips, carrying out subsequently the heat-welding of the strips themselves.

As well, known, suppositories and other similar pharmaceutical products are enclosed in individual containers, obtained from the coupling of two strips or bands of suitable material. Obviously, each package includes a plurality of the aforesaid suppositories, enclosed in separate recesses, delimited by subsequent shaped portions of the two coupled bands.

Such packaging is required by the need for maintaining the individual suppositories out of contact with the ambient air till the time of their utilization.

An even more important feature resides in the fact that said containers should prevent moisture from reaching the inside, as this would be harmful to the composition of the suppositories. Such a peculiar characteristic feature is ensured by sheet aluminium, which cannot be, however, subjected to drawing operations for the arrangement of the recesses, designed to contain the suppositories themselves.

The above difficulties are overcome by the container making, forming and heat-welding machine according to the present invention. To permit forming of relatively deep recesses, the machine forms first a series of very closely provided corrugations of minimum width, extending transversally relative to the strips. By such arrangement, the recesses for containing the suppositories or other products, preferably pharmaceuticals or sweets, are simply obtained by embossing of suitable portions of the two corrugated strips. The latter, in order to make the heat-welding possible, are grooved in longitudinal sense external to the shaped recesses, so as to provide substantially knurled surface portions. Practically speaking, the aforesaid corrugating operation is obtained by means of a pair of grooved contact rotating rollers, between which the two overlapped aluminium strips are caused to pass. Said strips are then separated and conveyed between two shaped platens arranged in two horizontal parallel planes. Between said platens and in equidistant positions therefrom there are placed a plurality of side-to-side arranged moulds, showing an approximately ogival configuration. It should be stated here that the aforesaid shaped platens are driven by articulated arms, suitably coupled so as to be moved by a synchronous movement toward and away from the ogival moulds. By such arrangement, half of each recess designed to contain the suppositories is obtained in one strip and the other half in the other strip. The thus shapped strips are then shifted into a heat-welding device, which shows essentially a mechanical structure identical with the structure of said forming device.

Figure 2:
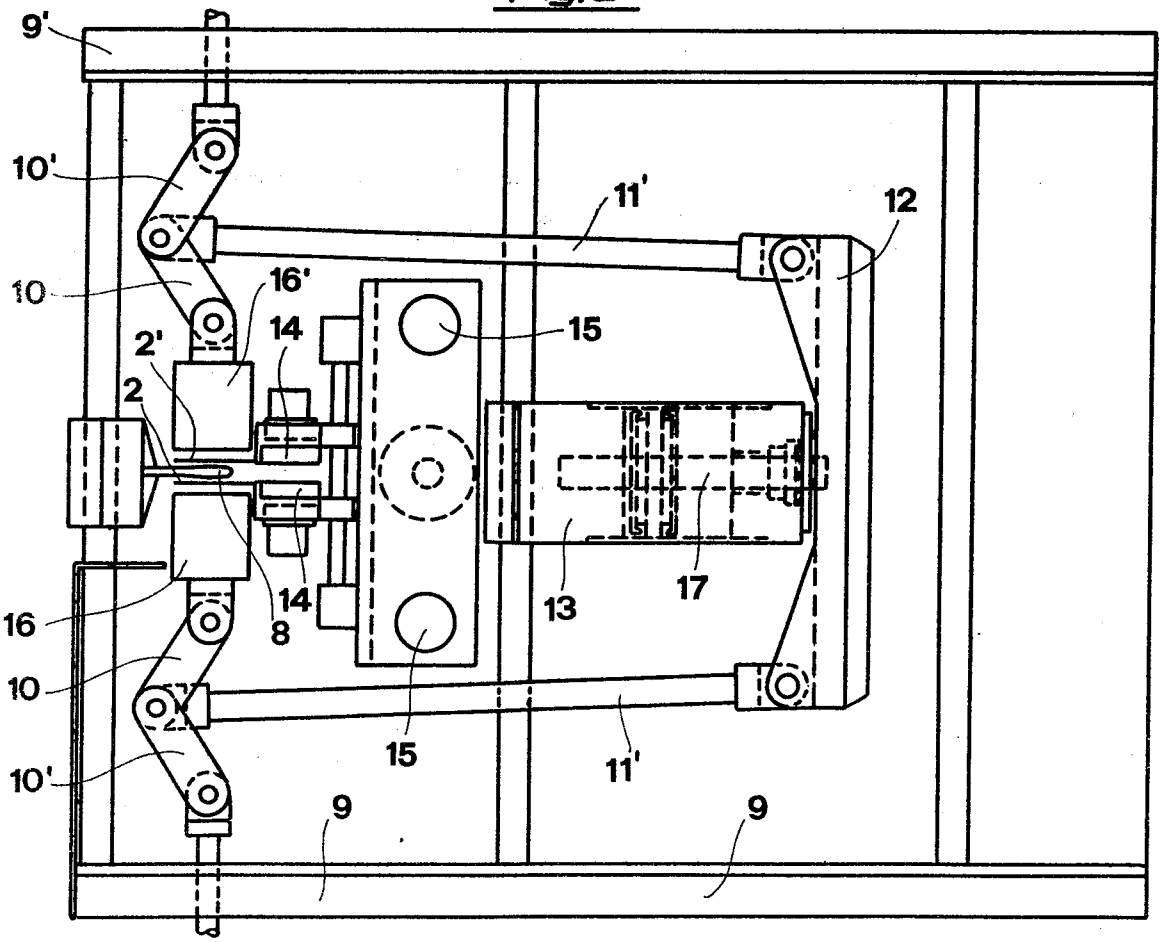

These and further characteristic features of a functional and constructional nature of the container making machine for the forming of recesses, starting from two overlapped aluminium strips and heat-welding of the strips to each other according to the present invention, will be better understood from perusal of the various figures on the accompanying drawings, in which:

FIG. 1 represents schematically in a front view the operating parts of the aforesaid machine; and FIG. 2 shows a side view of the forming device of said machine.

Referring now particularly to the figures on the accompanying drawings the container making machine of this invention includes two parallel shafts 1 and 1' with horizontal axes, on which there are placed two rolls of aluminium strips 2 and 2'.

Downstream of said shafts 1 and 1' there are placed two gears 4 and 4' or grooved rollers, rotating in contact relationship, which form a very closely arranged corrugation on the aluminium strips passed therebetween.

The latter may also be alternatively formed with staggered small depressions by means of points on small wheels, rods and the like. The deformed aluminium strips are then separated through a suitable mutual distance by means of the pair of small rollers 5 and 5' and conveyed between two opposed platens 6 and 6'.

In the opposite surfaces of said plates there are formed a plurality of grooves 7 extending from one edge to just short of the other edge of each platen, whereas a thin planar member provided with enlargements 8 of substantially ogival configurations respectively aligned with the grooves or recesses 7 is placed along a plane equidistant from the surfaces of the platens.

The aforementioned platens 6 and 6' are connected to beams 9 and 9' of the machine by means of pairs of hinged plates 10 and 10', articulated each at their mutual hinged portion by a pivot pin 11.

Said two pivot pins 11 are in turn connected by connecting rods 11' to a crosshead 12, integral with the piston rod 17 of a piston in cylinder 13. By using the container making machine of this invention, the movement of the platens 6 and 6' towards the members 8 takes place perfectly synchronized. The shaped portions of the two strips 2 and 2' are then shifted by means of the pliers 14, which may slide along the guides 15, between the two platens 16 and 16' of a heat-welding device.

The latter shows a mechanical structure essentially identical with the structure of the above-described forming device.

It should be stressed here that the opposite surfaces of the platens 16 and 16' also show longitudinal grooves, adapted to forms on the non-recessed portions of the coupled aluminium strips a knurling effect.

The platens 16 and 16' are further suitably heated in order to effect by their pressure the heat-welding of the coupled aluminium strips. From the foregoing and from perusal of the various figures on the accompanying drawings one may see easily the functional character and the practical application of the recess forming machine according to this invention starting from aluminium strips, coupled with each other and subsequently heat-welded.

I claim:

1. A container making machine for forming a plurality of identical equidistantly spaced apart recesses in two aluminum strips, comprising support means; a pair of corrugating rollers mounted on said support means rotatable about parallel axes and being formed on the periphery thereof with closely arranged corrugating elements extending parallel to said axes; means for guiding said aluminum strips between said corrugating rollers whereby said strips are formed with closely adjacent corrugations extending transverse to the longitudinal direction of said strips; recess forming means downstream of said rollers and comprising a pair of platens mounted on said support means movable toward and away from each other with each platen having recesses in a face thereof parallel to and facing corresponding recesses in the face of the other platen with a plurality of recesses in each platen equidistantly spaced from each other and of a configuration according to the recesses to be formed in said strips, a single planar member stationarily mounted on said support means between said faces of said platens and having a plurality of enlarged portions respectively aligned with said recesses in said platens and having respectively outer surfaces substantially matching said recesses in said faces of said platens, and means for moving said platens between an inactive position in which said faces thereof are spaced considerably from said planar member and an active position in which said faces are closely adjacent to said planar member so that the two aluminum strips which pass on opposite sides of said planar member while said platens are in said inoperative positions are formed with said recesses when said platens are moved to said operative positions; welding means downstream of said recess forming means and comprising a pair of heated platens each having recesses in a face thereof parallel to and facing like recesses in the other heated platen with said recesses spaced from each other and of a configuration equal to the spacing and configuration of the recesses of the platens of said recess forming means, and means mounted on the support means and connected to said heated platens for moving the same between an inactive position and an active position in which said faces of said heated platens press the two strips passed therebetween against each other to weld said strips to each other; and means arranged to engage superimposed edges of said strips for transporting the same stepwise between said rollers, said platens of said recess forming means, and said heated platens of said welding means.

2. A container making machine as defined in claim 1, and including a pair of parallel shafts mounted on said support means upstream of said rollers and respectively adapted to receive two rolls of aluminum strips, and a pair of guide rollers between said shafts and said corrugating rollers.

3. A container making machine as defined in claim 1, and including a pair of small diameter guide rollers between said corrugating rollers and said recess forming means for spacing said strips passed in abutting relationship between said corrugating rollers transversely from each other downstream of said corrugating rollers.

4. A container making machine as defined in claim 1, wherein said transporting means comprise pincer means arranged on said support means movable between an open and a closed position for gripping in said closed position edges of said superimposed aluminum strips, and guide means on said support means mounting said pincer means for reciprocating movement in longitudinal direction of the strips.

5. A container making machine as defined in claim 1, wherein said means for moving said platens between said positions thereof comprise a pair of toggle means each connected at opposite ends to said support means and one of said platens, and means for moving said toggle means between a folded and a straightened position.

6. A container making machine as defined in claim 1, wherein said means for moving said platens between said positions thereof comprise a pair of links for each platen, a pivot pin connecting adjacent ends of said links of each pair to each other, pivot means connecting the other end of one link of each pair to said support means and the other end of the other link of each pair to the respective platen, a cylinder mounted on said support means, a piston movable in said cylinder, a crosshead connected to said piston for movement therewith, and a pair of connecting rods connected at opposite ends to said crosshead and said pivot pin of each of said pair of links.

7. A container making machine as defined in claim 1, wherein each of said heated platens is provided on said face thereof with longitudinally extending grooves between said recesses.

* * * * *